US006399020B1

(12) United States Patent
Lee et al.

(10) Patent No.: US 6,399,020 B1
(45) Date of Patent: Jun. 4, 2002

(54) ALUMINUM-SILICON ALLOY HAVING IMPROVED PROPERTIES AT ELEVATED TEMPERATURES AND ARTICLES CAST THEREFROM

(75) Inventors: Jonathan A. Lee, Madison; Po-Shou Chen, Huntsville, both of AL (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/688,729

(22) Filed: Oct. 11, 2000

Related U.S. Application Data

(60) Continuation-in-part of application No. 09/322,768, filed on May 25, 1999, now abandoned, which is a continuation-in-part of application No. 09/218,675, filed on Dec. 22, 1998, now abandoned, which is a division of application No. 09/152,469, filed on Sep. 8, 1998, now abandoned.

(51) Int. Cl.[7] ..... C22C 21/02; C22C 21/04

(52) U.S. Cl. ..... 420/532; 420/535; 420/537; 420/538; 148/439

(58) Field of Search ..... 420/528, 532, 420/535, 544, 537, 538; 148/437, 439

(56) References Cited

U.S. PATENT DOCUMENTS 5,217,546 A * 6/1993 Eady et al. ..... 148/439
5,484,492 A * 1/1996 Rogers et al. ..... 148/437

FOREIGN PATENT DOCUMENTS

JP 408104937 A * 4/1996 ..... C22C/21/02

OTHER PUBLICATIONS

Mielke, Steffens, Beer, Henning; New Aluminum Piston Alloy with Increased fatigue Strength at High Temperatures; SAE International The Engineering Society for Advancign Mobility Land Sea Air and Space; Feb. 23–26, 1998; pp. 41–45; 980687; society of Automotive Engineers, Inc.; Warrendale, PA, USA. . . .

(List continued on next page.)

*Primary Examiner*—Roy King
*Assistant Examiner*—Harry D. Wilkins, III
(74) *Attorney, Agent, or Firm*—James J. McGroary

(57) ABSTRACT

An aluminum alloy suitable for high temperature applications, such as heavy duty pistons and other internal combustion applications, having the following composition, by weight percent (wt %):

| | |
|---|---|
| Silicon | 11.0–14.0 |
| Copper | 5.6–8.0 |
| Iron | 0–0.8 |
| Magnesium | 0.5–1.5 |
| Nickel | 0.05–0.9 |
| Manganese | 0–1.0 |
| Titanium | 0.05–1.2 |
| Zirconium | 0.12–1.2 |
| Vanadium | 0.05–1.2 |
| Zinc | 0.05–0.9 |
| Strontium | 0.001–0.1 |
| Aluminum | balance. |

In this alloy the ratio of silicon:magnesium is 10–25, and the ratio of copper:magnesium is 4–15. After an article is cast from this alloy, the article is treated in a solutionizing step which dissolves unwanted precipitates and reduces any segregation present in the original alloy. After this solutionizing step, the article is quenched, and is then aged at an elevated temperature for maximum strength.

4 Claims, 1 Drawing Sheet

OTHER PUBLICATIONS

J. A. Taylor, G. B. Schaffer, D. H. StJohn; Ther Effect of Iron Content on the Formation of Porosityand Shrinkage Defects in Al–Si–Cu–Mg Allwy Casting; Solidification Processing 1997 Proceedings of the 4th Decennia; International Conference on Solidification Processing; Jul. 7–10, 1997; Ranmoor House, University of Scheffield, UK. . . .

Hatch, John E.; Constitution of Alloys; Aluminum Properties and Physical Metallurgy; 1984; pp. 25–27; Chapter 2; American Society for Metals; Metals Park, OH; USA. . . .

Hatch, John E.; Properties and Physical Metallurgy, Specific Alloying Elements and Impurities; Aluminum Properties and Physical Metallurgy; 1984; pp. 224–229; American Society for Metals. Metals Park, OH; USA. . . .

W. Kowbel, W. Chellappa, J.C. Withers; Applications of Net–Shape Molded Carbon–carbon Compositeis in IC Engines; Journal of Advanced Materials: Jul. 1996; pp.2–7; vol. 27 No. 4; USA. . . .

A. J. Shakesheff, P. D. Pitcher; Elevated Temperature Performance of Particulate Reinforced Aluminium Alloys; Materials Science forum, Proceedings of the 5th International conf. ICAA5, Jul. 1–5, 1996; pp. 1133–1138.; vol. 217–222, 1996 Transtec Publications Switzerland. . . .

Rohatgi, Pradeep; Cast Aluminum–Matrix Composites for Automotive Applications; JOM the Journal of the Minerals, Metals & Materials Society; April 1991; pp. 10–15. . . .

R. R. Bowles; D. L. Mancini, M. W. Toaz; Metal Matrix composites Aid Piston Manufacture; CIM Technology, Manufacturing Engineering; May 1987; pp. 61–62. . . .

* cited by examiner

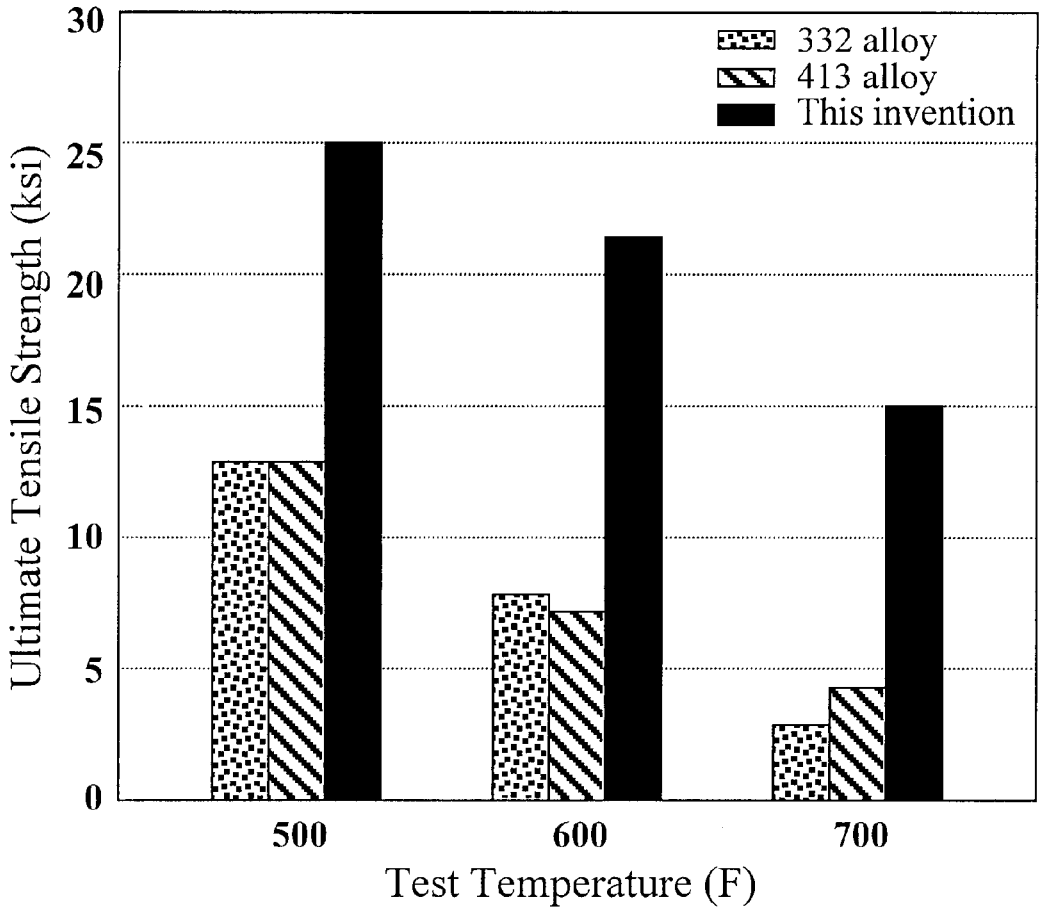
30
25
20
15
10
5
0
Ultimate Tensile Strength (ksi)
332 alloy
413 alloy
This invention
500
600
700
Test Temperature (F)

ALUMINUM-SILICON ALLOY HAVING IMPROVED PROPERTIES AT ELEVATED TEMPERATURES AND ARTICLES CAST THEREFROM

RELATED APPLICATIONS

This application is a continuation-in-part of application Ser. No. 09/322,768 filed May 25, 1999, now abandoned, which application is a continuation-in-part of application Ser. No. 09/218,675, filed Dec. 22, 1998, now abandoned, which application is a division of application Ser. No. 09/152,469, filed Sep. 8, 1998 now abandoned.

ORIGIN OF THE INVENTION

This invention described herein was made under a NASA contract and is subject to the provisions of Public Law 96-517 (35 USC 202) in which the contractor has elected not to retain title.

BACKGROUND OF THE INVENTION

1. Field of the Invention

This invention relates to aluminum alloys, and specifically to high tensile strength aluminum-silicon hypoeutectic and eutectic alloys suitable for high temperature applications such as heavy-duty pistons and other internal combustion applications.

2. Discussion of the Related Art

Aluminum-Silicon (Al—Si) casting alloys are the most versatile of all common foundry cast alloys in the production of pistons for automotive engines. Depending on the Si concentration in weight percent, the Al—Si alloy systems fall into three major categories: hypoeutectic (<12 wt % Si), eutectic (12–13 wt % Si) and hypereutectic (14–25 wt % Si). However, commercial applications for hypereutectic alloys are relatively limited because they are among the most difficult Al alloys to cast and machine due to the high Si contents. When high Si content is alloyed into Al, it adds a large amount of heat capacity that must be removed from the alloy to solidify it during a casting operation. Significant variation in the sizes of the primary Si particles can be found between different regions of the cast article, resulting in a significant variation in the mechanical properties for the cast article. The primary crystals of Si must be refined in order to achieve hardness and good wear resistance. For these reasons, hypereutectic alloys are not very economical to produce because they have a broad solidification range that results in poor castability and requires a special foundry's process to control the high heat of fusion and microstructure. Furthermore, expensive diamond toolings must be used to machine parts, such as pistons, that are made from hypereutectic Al—Si castings. On the other hand, the usage of hypoeutectic and eutectic alloys are very popular for the industry, because they are more economical to produce by casting, simpler to control the cast parameters, and easier to machine than hypereutectic. However, most of them are not suitable for high temperature applications, such as in the automotive field, for the reason that their mechanical properties, such as tensile strength, are not as high as desired in the temperature range of 500° F.–700° F. Current state-of-the-art hypoeutectic and eutectic alloys are intended for applications at temperatures of no higher than about 450° F. Above this elevated service temperature, the major alloy strengthening phases such as the θ' ($Al_2Cu$) and S' ($Al_2CuMg$) will precipitate rapidly, coarsen, or dissolve, and transform themselves into the more stable θ ($Al_2Cu$) and S ($Al_2CuMg$) phases. This undesirable microstructure and phase transformation results in drastically reduced mechanical properties, more particularly the ultimate tensile strength and high cycle fatigue strengths, for hypoeutectic and eutectic Al—Si alloys.

One approach taken by the art is to use ceramic fibers or ceramic particulates to increase the strength of hypoeutectic and eutectic Al—Si alloys. This approach is known as the aluminum Metal Matrix Composites (MMC) technology. For example, R. Bowles has used ceramic fibers to improve tensile strength of a hypoeutectic 332.0 alloy, in a paper entitled, "Metal Matrix Composites Aid Piston Manufacture," *Manufacturing Engineering,* May 1987. Moreover, A. Shakesheff has used ceramic particulate for reinforcing another type of hypoeutectic A359 alloy, as described in "Elevated Temperature Performance of Particulate Reinforced Aluminum Alloys," *Materials Science Forum,* Vol. 217–222, pp. 1133–1138 (1996). In a similar approach, cast aluminum MMC for pistons using eutectic alloy such as the 413.0 type, has been described by P. Rohatgi in a paper entitled, "Cast Aluminum Matrix Composites for Automotive Applications," *Journal of Metals,* April 1991.

Another approach taken by the art is the use of the Ceramic Matrix Composites (CMC) technology in the place of hypoeutectic and eutectic alloys. For example, W. Kowbel has described the use of non-metallic carbon-carbon composites for making pistons to operate at high temperatures in a paper entitled, "Application of Net-Shape Molded Carbon-Carbon Composites in IC Engines," *Journal of Advanced Materials, July* 1996. Unfortunately, the material and processing costs of these MMC and CMC technology approaches are substantially higher than those produced using conventional casting, and they cannot be considered for large usage in mass production, such as engine pistons.

SUMMARY OF THE INVENTION

A first object of the present invention is to provide a composition of an aluminum alloy that can be used as a hypoeutectic or eutectic Al—Si alloy which is more economical to produce by conventional gravity casting and easier to machine than hypereutectic alloys. A second object of the present invention is to provide a composition having improved mechanical properties suitable for high temperature application, such as heavy-duty pistons and other internal combustion applications.

According to the present invention, an aluminum alloy having the following composition, by weight percent (wt %), is provided:

| | |
|---|---|
| Silicon (Si) | 11.0–14.0 |
| Copper (Cu) | 5.6–8.0 |
| Iron (Fe) | 0–0.8 |
| Magnesium (Mg) | 0.5–1.5 |
| Nickel (Ni) | 0.05–0.9 |
| Manganese (Mn) | 0–1.0 |
| Titanium (Ti) | 0.05–1.2 |
| Zirconium (Zr) | 0.12–1.2 |
| Vanadium (V) | 0.05–1.2 |
| Zinc (Zn) | 0.05–0.9 |
| Strontium (Sr) | 0.001–0.1 |
| Aluminum (Al) | balance |

In the aluminum alloy according to the present invention, the ratio of Si:Mg is 10–25; and the ratio of Cu:Mg is 4–15.

After an article is gravity cast from this alloy, the article is treated in a solutionizing step which dissolves unwanted precipitates and reduces any segregation present in the original alloy. After the solutionizing step, the article is quenched, and is then aged at an elevated temperature for maximum strength.

BRIEF DESCRIPTION OF THE DRAWING

The Drawing is a chart showing a comparison of an alloy according to the present invention with typical conventional hypoeutectic (332.0) and eutectic (413.0) alloys. The chart shows tensile strength, tested at 500° F., 600° F., and 700° F., after exposure of the cast article to a temperature of 500° F. for 100 hours, 600° F. for 100 hours, and 700° F. for 100 hours, respectively.

DETAILED DESCRIPTION OF THE INVENTION

The alloy of the present invention is marked by an ability to perform in cast form at high servicing temperature. However, best properties are obtained in the forged and heated conditions. The aluminum alloy of the present invention, which is suitable for high temperature applications and which can be used as a hypoeutectic or eutectic Al—Si alloy, is composed of the following elements, by weight percent:

| | |
|---|---|
| Si | 11.0–14.0 |
| Cu | 5.6–8.0 |
| Fe | 0–0.8 |
| Mg | 0.5–1.5 |
| Ni | 0.05–0.9 |
| Mn | 0–1.0 |
| Ti | 0.05–1.2 |
| Zr | 0.12–1.2 |
| V | 0.05–1.2 |
| Zn | 0.05–0.9 |
| Sr | 0.001–0.1 |
| Al | balance |

In the alloy of the present invention the ratio of Si:Mg is 10–25; preferably 14–20; and the ratio of Cu:Mg is 4–15.

Iron and manganese may be omitted from the alloy according to the present invention. However, these elements tend to exist as impurities in most aluminum alloys due to common foundry practices. Eliminating them completely from the alloy (i.e., by alloy refining techniques) will increase the cost of the alloy significantly.

Silicon gives the alloy a high elastic modulus and low thermal expansion when the concentration is greater than 10% wt. Si. For this reason, a low thermal expansion property is an important factor for eutectic alloy (12%–13%). Finally, the addition of Si also improves fluidity of molten aluminum alloy to enhance the castability. The alloy will not require expensive diamond tooling for machining if the silicon concentration is kept well below about 14 wt %.

Copper coexists with magnesium and forms a solid solution in the matrix to give the alloy age-hardening properties, thereby improving the high temperature strength. Copper also forms the θ' intermediate phase ($Al_2Cu$), and is the most potent strengthening element in this new alloy. The enhanced high strength at high temperatures will be affected if the copper wt % level is not adhered to.

Moreover the alloy strength can only be maximized effectively by the simultaneous formation for both of the θ' and S' metallurgical phases, using proper addition of magnesium into the alloy relative to the element of copper and silicon. Experimentally, it is found that an alloy with a significantly high level of magnesium will form mostly S' phase with insufficient amount of θ' phase. On the other hand, an alloy with a lower level of magnesium contains mostly θ' with insufficient amount of S' phase. To maximize the formation of both the θ' and S' phases, the alloy composition was specifically formulated with copper-to-magnesium ratios ranging from 4 to 15, with a minimum value for magnesium of no less than 0.5 wt %. In addition to the Cu/Mg ratio, the silicon-to-magnesium ratio should be kept in the range of 10 to 25, preferably 14 to 20, to properly form the $Mg_2Si$ intermetallic compound as a minor strengthening phase, in addition to the primary θ' and S' phases.

Titanium and vanadium form primary crystals of Al—Ti and Al—V compounds. Since these crystallized intermetallic compounds act as nuclei for solidification, the grain size upon solidification is fine. Titanium and vanadium also function as dispersion strengthening agents, in order to improve the high temperature tensile strength.

Zirconium forms primary crystals of an Al—Zr compound. The crystallized intermetallic compounds also act as particles for dispersion strengthening. Zirconium also forms a solid solution in the matrix to a small amount, thus enhancing the formation of GP (Guinier-Preston) zones which are the Cu—Mg rich regions, and the θ' intermediate phase in the Al—Cu—Mg system to improve the age-hardening properties.

Nickel improves tensile strength at elevated temperatures by forming Al—Cu—Ni intermetallic compounds.

Strontium is used to modify the Al—Si eutectic phase. The strength and ductility of hypoeutectic and eutectic are substantially improved by using Strontium as a Al—Si modifier. Effective modification is achieved at a very low additional level, but a range of recovered strontium of 0.001 to 0.1 wt. % is commonly used.

The alloy of this invention is marked by an ability to perform in cast form using conventional gravity cast or die-casting. The alloy is cast conventionally in the temperature range of about 1325° F. to 1450° F. However, best properties are obtained using a forged, special casting technique, such as squeeze casting, under heat treated conditions. Castings of this alloy are cast into approximate shape and are then machined or ground to final dimensions.

An article, such as an engine block or a piston, is cast from the alloy and the article is then solutionized at a temperature of 900° F. to 1000° F. for fifteen minutes to four hours. The purpose of the solutionizing is to dissolve unwanted precipitates and reduce any segregation present in the alloy. For uses at temperatures of 500° to 700° F. the solutioning treatment is not required.

After solutionizing, the article is quenched in a quenching medium at a temperature within the range of 120° F. to 300° F. The most preferred quenching medium is boiling water. After quenching, the article is aged at a temperature of about 400° F. to about 500° F. for four to 16 hours. Preferably, the aging process is preformed at a temperature within the range of 425° F. to 485° F. for six to 12 hours.

The following table illustrates the dramatic improvement in tensile strength at elevated temperatures for the alloy according to the present invention. This table compares the tensile strengths of this invention with two well-known hypoeutectic (332) and eutectic (413) alloys, after an article cast from this alloy has been held at 500° F., 600° F. and 700° F. for 100 hours. The articles were tested at elevated temperatures of 500° F., 600° F. and 700° F., respectively. It will be noted that the tensile strength of the alloy according to the present invention is more than three times that of the well-known eutectic 413, and more than four times that of known hypoeutectic 332 alloy when tested at 700° F. With such a dramatic improvement in tensile strength offered by the alloy according to the present invention, it enables the design and production of new pistons to achieve better performance, while utilizing less material. By using less material, the piston weight and the production cost are also reduced significantly.

In recent years, increasingly stringent exhaust emission regulations for internal combustion engines have forced piston designers to reduce the piston's crevice volume (the space between the piston top-land and the cylinder bore) by moving the piston ring closer to the top of the piston. Such piston design modifications reduce exhaust emissions but require a stronger cast alloy to prevent failure of the piston top-land, due to high mechanical cyclic loading at elevated temperatures. Unfortunately, most commercially available piston alloys are unable to meet a constant demand for higher strength at elevated temperatures of above 500° F. Indeed, the dramatic improvement in strength provided by the alloy according to the present invention is the most significant factor that will enable high performance gasoline and diesel pistons to meet exhaust emission standards, improve auto engine performance, and utilize less material, which can lead to reducing piston weight and cost.

TABLE

| | Ultimate Tensile Strength (ksi) at Test Temperatures (° F.) | | |
|---|---|---|---|
| Alloy | 500° F. | 600° F. | 700° F. |
| This invention | 25 | 21 | 15 |
| 332.0 (hypoeutectic) | 13 | 7.5 | 3.5 |
| 413.0 (eutectic) | 13 | 7 | 4.5 |

What is claimed is:

1. An aluminum alloy, suitable for high temperature applications, comprising the following elements, by weight percent:

| | |
|---|---|
| Silicon | 11.0–14.0 |
| Copper | 5.6–8.0 |
| Iron | 0–0.8 |
| Magnesium | 0.5–1.5 |
| Nickel | 0.05–0.9 |
| Manganese | 0–1.0 |
| Titanium | 0.05–1.2 |
| Zirconium | 0.12–1.2 |
| Vanadium | 0.05–1.2 |
| Zinc | 0.05–0.9 |
| Strontium | 0.001–0.1 |
| Aluminum | balance, |

wherein the ratio of silicon:magnesium is 10–25, and the ratio of copper-:magnesium is 4–15.

2. An article cast from the alloy of claim 1.

3. The article of claim 2 having a tensile strength of at least 21 ksi at 600° F. after being aged at a temperature within the range of 400° F. to 500° F. for four to 16 hours.

4. The article of claim 3, which has been aged at a temperature between about 425° F. and 485° F. for six to 12 hours.

* * * * *